US006155045A

United States Patent [19]

Dürr et al.

[11] Patent Number: 6,155,045

[45] Date of Patent: Dec. 5, 2000

[54] ENGINE FLANGE

[75] Inventors: Gerd Dürr, Neustadt/Pfalz; Wolfgang Baudisch, Siebeldingen/Pfalz; Georg Reuther, Hochstadt/Pfalz, all of Germany

[73] Assignee: Heinrich Gillet GmbH & Co. KG, Edenkoben, Germany

[21] Appl. No.: 09/199,496

[22] Filed: Nov. 25, 1998

[30] Foreign Application Priority Data

Nov. 26, 1997 [DE] Germany ..... 297 20 941

[51] Int. Cl.[7] ..... F01N 7/10

[52] U.S. Cl. ..... 60/323; 60/322; 285/405; 285/412; 277/598

[58] Field of Search ..... 60/323, 272, 322; 277/598, 592; 285/405, 412, 408

[56] References Cited

U.S. PATENT DOCUMENTS

| | | | |
|---|---|---|---|
| 2,847,819 | 8/1958 | Muller . | |
| 3,716,992 | 2/1973 | Stahl | 60/272 |
| 4,300,273 | 11/1981 | Lockhard | 29/156.4 R |
| 4,813,687 | 3/1989 | Nakayama et al. | 277/26 |
| 4,813,691 | 3/1989 | Schoenborn | 277/235 B |
| 5,582,415 | 12/1996 | Yoshida et al. | 277/235 A |
| 5,609,345 | 3/1997 | Miura et al. | 277/180 |
| 5,636,515 | 6/1997 | Matsumoto et al. | 60/323 |
| 5,689,954 | 11/1997 | Blöcker et al. | 60/322 |
| 5,690,343 | 11/1997 | Tanaka et al. | 277/235 B |
| 5,791,660 | 8/1998 | Belter | 277/598 |
| 5,893,566 | 4/1999 | Miyaoh et al. | 277/592 |
| 5,911,683 | 6/1999 | Cui et al. | 60/302 |
| 5,924,701 | 7/1999 | Schweiger | 277/597 |
| 5,979,906 | 11/1999 | Silvian | 277/593 |

FOREIGN PATENT DOCUMENTS

| | | |
|---|---|---|
| 178 430 | 4/1986 | European Pat. Off. . |
| 1 576 357 | 5/1970 | Germany . |
| 31 29 351 | 9/1983 | Germany . |
| 296 15 840 | 12/1996 | Germany . |

*Primary Examiner*—Thomas Denion
*Assistant Examiner*—Binh Tran
*Attorney, Agent, or Firm*—Cohen, Pontani, Lieberman & Pavane

[57] ABSTRACT

A flange for attaching an exhaust manifold to an engine block. The flange having two layers of sheet metal plates accurately connected to each other and having openings which are aligned with the cylinder outlets of the engine block, and attachment openings which are placed on stay bolts on the engine block. The flange includes at least two flange portions, whereby the plates of adjacent flange portions overlap in the area at least of one attachment opening. The contact surfaces can have a slide coating in the overlap area.

3 Claims, 2 Drawing Sheets

ENGINE FLANGE

BACKGROUND OF THE INVENTION

1. Field of the Invention

The invention relates to flanges for attaching an exhaust manifold to an engine block.

2. Discussion of the Prior Art

Exhaust manifolds, which collect the hot exhaust gases emerging from the cylinder outlets of the engine block and conduct these gases to an exhaust system consisting of exhaust pipes, a catalytic converter and a muffler, were originally manufactured as castings. For example, see U.S. Pat. No. 2,847,819. The greatest problem has thereby been presented by the flange, with the help of which the exhaust manifold is screwed to the engine block. Firstly, it must be possible to attach the flange in a gas-tight manner. Secondly, modem engine design calls for flanges of certain thicknesses and shapes, which leads to considerable expense in casting.

For this reason, pipe elbows are being increasingly used. These consist of elbow pipes of suitable length and shape, which are welded to a flange.

Particular demands are also placed on the flange, with the help of which the exhaust manifold is screwed to the engine block. For example, the flanges must be gas-tight and have high intrinsic rigidity. Problems also result from the high temperatures and the associated thermal expansion differences. In this regard, see German reference DE OS 15 76 357, which calls for each cylinder outlet to have its own small flange.

German reference DE 31 29 351 C2 discloses a flange that is divided in the thickness direction. The incoming tubular conduit of the manifold is welded only to one part of the flange. This flange part, in turn, is then welded to the other flange part. In this way, forces created by heat stress are to be better intercepted. Again, each cylinder outlet has its own small-area flange.

Finally, European reference EP 0 178 430 B1 discloses an exhaust manifold with a flange composed of four relatively thin sheet metal plates, which can consist at least partly of high-quality steel. The sheet metal plates are individually stamped, accurately stacked with the help of adjustment borings and adjustment pins and, finally, hard-soldered. The top sheet metal plate is equipped with an eyelet, into which an elbow pipe can be welded. This flange is intended for two cylinder outlets.

In the meantime, of course, it has also proved possible to produce flanges that are composed of sheet metal plates and cover all of the cylinder outlets, e.g., four, in a four-cylinder engine, in a single piece. Exhaust manifolds with such one-piece flanges, however, must be embodied very rigidly, so that the heat expansion resulting from the temperature differences among different individual parts can be absorbed without the flange becoming permeable. Rigidity thereby means heaviness.

Another solution of this problem is described in German reference DE 296 15 840 U. This flange comprises a single deep-drawn metal sheet.

SUMMARY OF THE INVENTION

The object of the present invention is to provide a flange composed of multiple sheet metal plates that combines the advantages of the known designs.

Pursuant to this object, and others which will become apparent hereafter, one aspect of the present invention resides in a flange having at least two flange portions with at least two layers, wherein plates of adjacent flange portions overlap in the area of at least one attachment opening.

Thanks to the present invention, it is possible to use simple sheet metal plates that are stamped and then connected to one another, e.g., by soldering, welding or mechanical connection, using known technology. Because the flange consists of multiple individual parts, relative movements are possible between the individual flange portions and elbow pipes. The assembly options are varied. There is greater freedom of design, because not all screw passages are needed on the inside cylinders. If, for example, two individual elbow pairs are provided for a four-cylinder engine, e.g., one elbow pair for cylinders 1+4 and another pair for cylinders 2+3, one of the two elbow pairs can be completely assembled except for the overlap points. The screws of the already assembled elbows can then be covered by the pipes of the elbows assembled subsequently. The solution according to the invention, compared with individual flanges with irregularly distributed screw positions, therefore has a relatively regular screw pattern, which is a precondition for good gas-tightness.

In an advantageous further embodiment of the invention, the sliding of the contact surfaces can be improved by a suitable coating.

At the overlap points, it is possible to provide a narrow attachment opening in the first plate for the purpose of accurate positioning, and a larger attachment opening in the second plate that permits relative movement.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
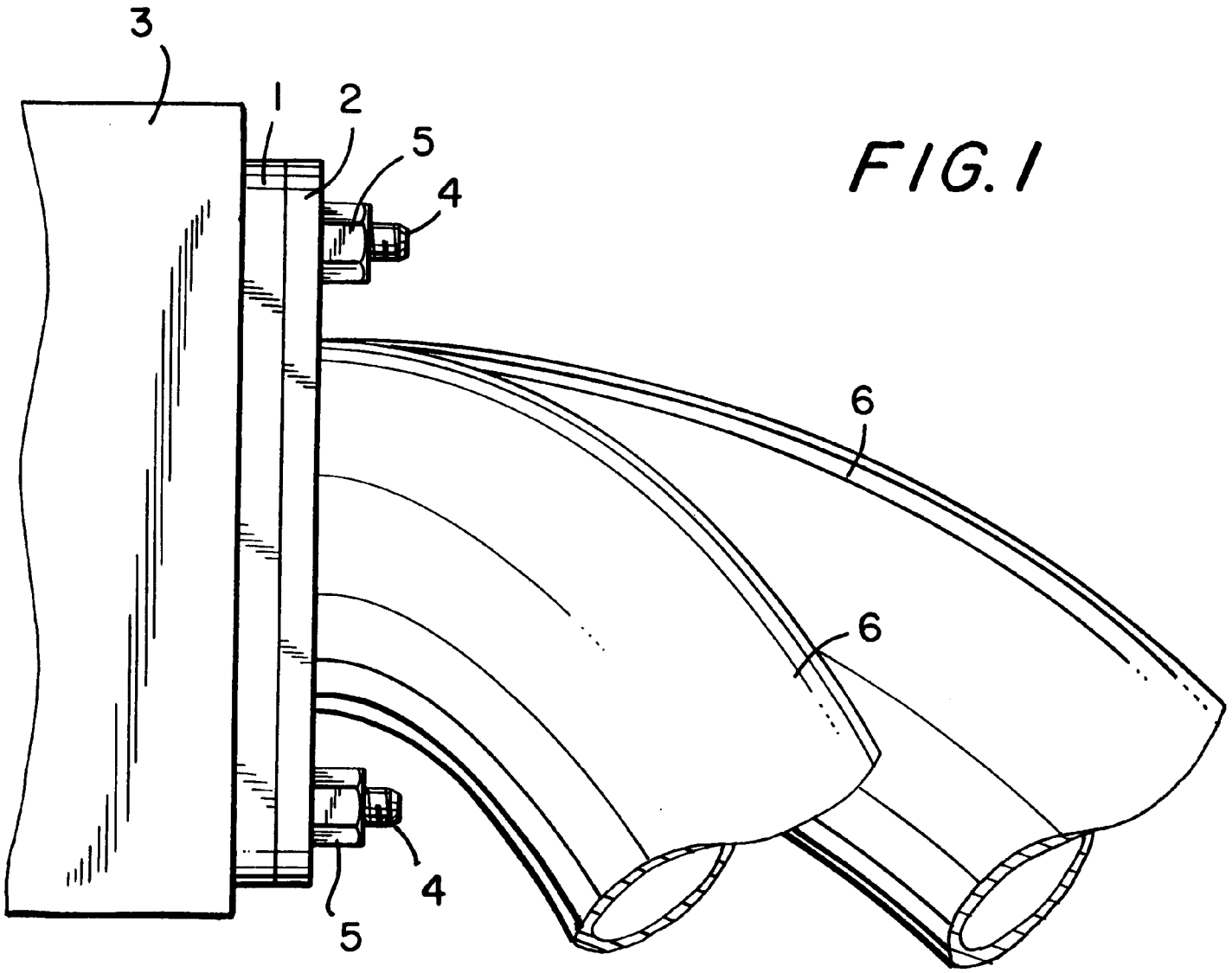
FIG. 1 is a schematic illustration of an exhaust manifold screwed to an engine block.

FIG. 1, in a purely schematic fashion, shows a side view of an exhaust manifold that is screwed to an engine block 3 with the help of stay bolts 4 and nuts 5. The flange comprises two sheet metal plates 1, 2 located one atop the other, which will be described in detail in reference to FIGS. 2 and 3. Welded to the flange 1, 2 are exhaust pipes 6, which lead to an exhaust system (not shown).

Figure 2:
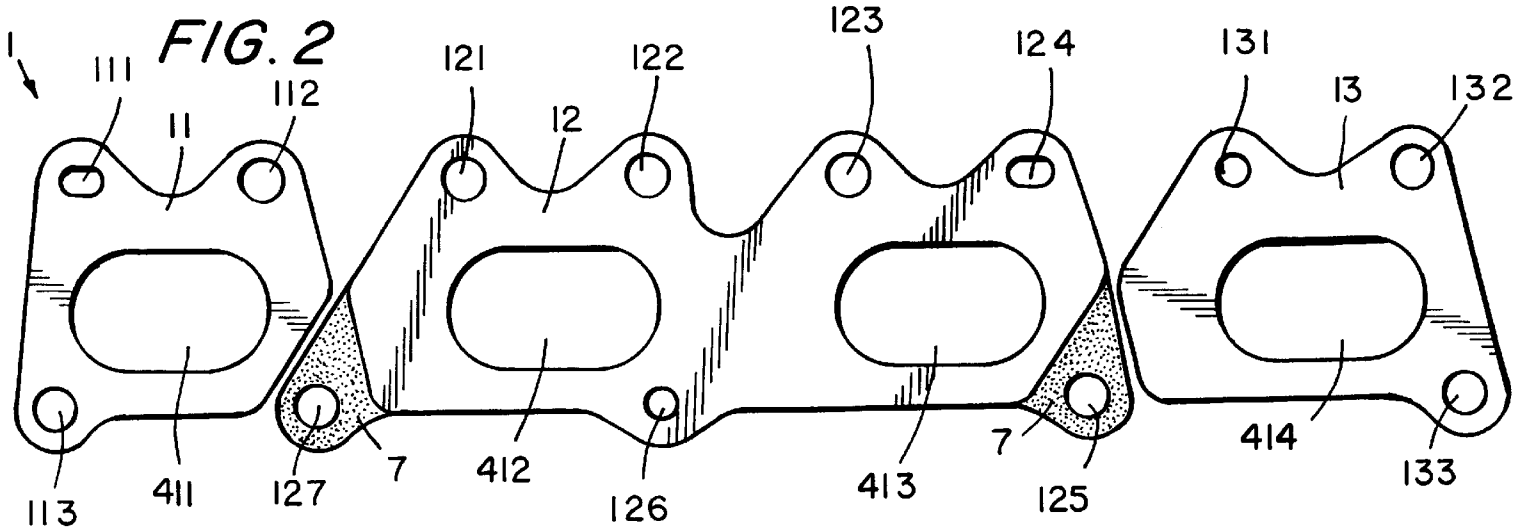
FIG. 2 is a top view of the lowest layer of a flange made of two layers of sheet metal plates.

FIG. 2 shows the first layer 1 of sheet metal plates 11, 12, 13 for producing a flange for the exhaust manifold. In the drawing, three separate sheet metal plates 11, 12, 13 with attachment openings 111 . . . 113; 121 . . . 127; 131 . . . 133 and cylinder outlet openings 411 . . . 414 are visible. The sheet metal plates 11, 12, 13 are located adjacent to and separated from each other. The attachment openings, particularly of the two outer sheet metal plates 11, 13, are distributed in a markedly irregular fashion.

Figure 3:
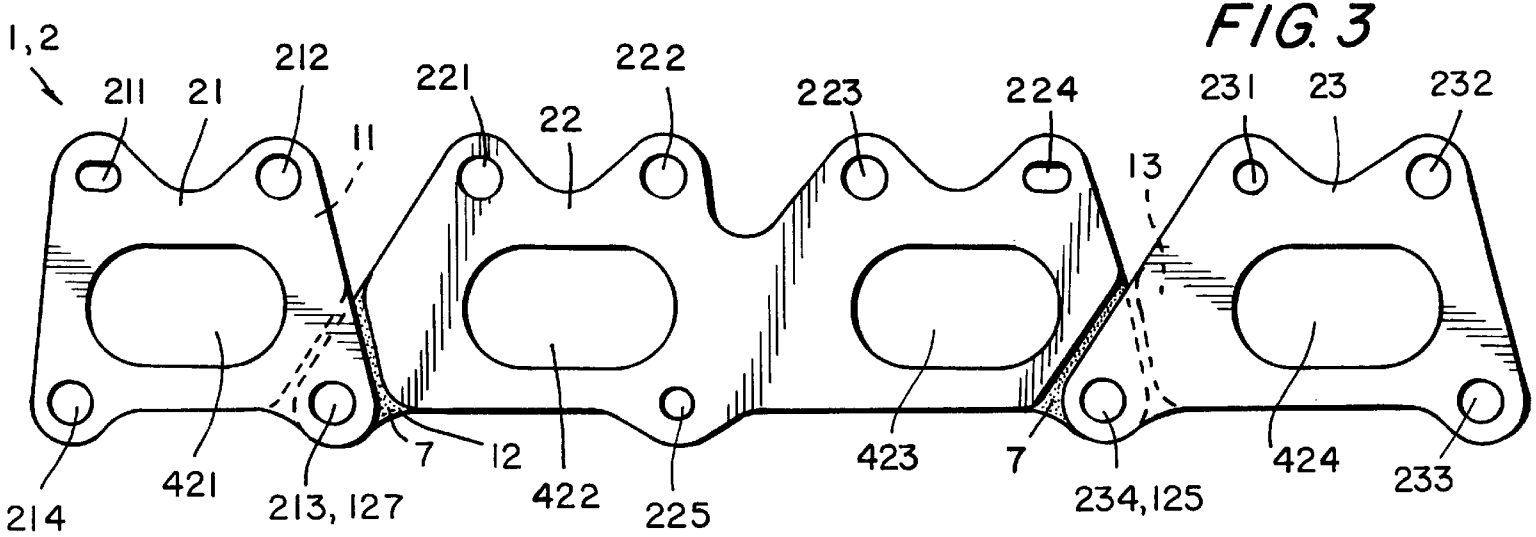
FIG. 3 is a top view of flange completed with a second layer of sheet metal plates.

FIG. 3 shows the flange after the placement of the second layer 2 of sheet metal plates 21, 22, 23 onto the first lowest layer 1. This creates three flange portions, whereby the attachment openings 211 . . . 214; 221 . . . 225; 231 . . . 234 of the upper layer 2 are aligned with the corresponding attachment openings of the lower layer 1. Similarly, the cylinder outlet openings 421 . . . 424 of the upper layer 2 are aligned with the cylinder outlet openings of the lower layer 1.

In the area of at least one attachment opening 213, 127; 234, 125, the plates 21, 12; 23, 12 of adjacent flange portions overlap. As a result, the flange potions can be placed onto the same stay bolt 4 and, together, screwed tight, so that all of the flange portions are screwed in an evenly distributed manner.

At the same time, the flanges portions can slide on each other in the area of their contact surfaces to compensate for heat expansion.

If necessary, their sliding can be improved by a suitable coating 7.

Of course, the principle of the invention can also be used with flanges that consist of one plate and multiple partial flanges and have a suitable contour at the overlap points, or flanges that are produced from more than two sheet metal plates and consist of more than three partial flanges.

The invention is not limited by the embodiments described above which are presented as examples only but can be modified in various ways within the scope of protection defined by the appended patent claims.

We claim:

1. A flange for attaching an exhaust manifold to an engine block, comprising at least two flange portions having at least two layers of sheet metal plates accurately connected to each other that have outlet openings aligned with the cylinder outlets of the engine block, and attachment openings which are placeable on stay bolts on the engine block, the plates of adjacent flange portions being arranged to overlap in an area of at least one of the attachment openings.

2. A flange as defined in claim 1, wherein in the overlap area the flange portions have contact surfaces provided with a slide coating.

3. Flange as defined in claim 1, wherein some of the attachment openings are enlarged in the overlap areas so as to permit relative movement of the flange portions.

* * * * *